US011397007B2

(12) United States Patent
Song et al.

(10) Patent No.: US 11,397,007 B2
(45) Date of Patent: Jul. 26, 2022

(54) ELECTRIC HEATER

(71) Applicant: LG Electronics Inc., Seoul (KR)

(72) Inventors: Misun Song, Seoul (KR); Changwoo Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 337 days.

(21) Appl. No.: 16/540,506

(22) Filed: Aug. 14, 2019

(65) Prior Publication Data

US 2020/0063972 A1 Feb. 27, 2020

(30) Foreign Application Priority Data

Aug. 21, 2018 (KR) ..... 10-2018-0097709

(51) Int. Cl.

| | |
|---|---|
| ***F24C 7/06*** | (2006.01) |
| ***F24C 7/08*** | (2006.01) |
| ***H05B 3/34*** | (2006.01) |

(52) U.S. Cl.

CPC ..... *F24C 7/062* (2013.01); *F24C 7/088* (2013.01); *H05B 3/34* (2013.01); *H05B 2203/007* (2013.01); *H05B 2203/013* (2013.01)

(58) Field of Classification Search

CPC ..... F24C 7/062; F24C 7/088; F24C 7/067; F24C 15/102; H05B 3/34; H05B 3/74; H05B 3/03; H05B 3/68; H05B 3/18; H05B 3/283; H05B 2203/013; H05B 2203/007; H05B 2203/003; H05B 2203/005

See application file for complete search history.

(56) References Cited

U.S. PATENT DOCUMENTS

| | | | |
|---|---|---|---|
| 3,883,719 | A | 5/1975 | Hurko |
| 4,763,099 | A | 8/1988 | Balderson |
| 4,859,835 | A | 8/1989 | Balderson |
| 4,973,826 | A | 11/1990 | Baudry et al. |

(Continued)

FOREIGN PATENT DOCUMENTS

| | | |
|---|---|---|
| CN | 1489882 | 4/2004 |
| CN | 1505441 | 6/2004 |

(Continued)

OTHER PUBLICATIONS

Extended European Search Report in European Application No. EP 19174086, dated Nov. 26, 2019, 5 pages.

(Continued)

*Primary Examiner* — Shawntina T Fuqua
(74) *Attorney, Agent, or Firm* — Fish & Richardson P.C.

(57) ABSTRACT

An electric heater includes a substrate, and a plane heating element that is located at a surface of the substrate and that includes a pattern portion having a start point and an end point that are connected to each other. The pattern portion includes a plurality of tracks that are spaced apart from one another, that have an arc shape, and that are arranged at positions from an inner side of the pattern portion to an outer side of the pattern portion, where lengths of the plurality of tracks increase from the inner side to the outer side. The plurality of tracks include at least two tracks that are arranged respectively about a first center of curvature and a second center of curvature that is different from the first center of curvature.

19 Claims, 10 Drawing Sheets

(56) References Cited

U.S. PATENT DOCUMENTS

| | | | | |
|---|---|---|---|---|
| 8,269,150 | B2 * | 9/2012 | Kim | H05B 3/68 219/482 |
| 2004/0074893 | A1 | 4/2004 | Wermbter | |
| 2009/0218333 | A1 | 9/2009 | Kaastra | |
| 2015/0208669 | A1 | 7/2015 | Klock et al. | |

FOREIGN PATENT DOCUMENTS

| | | |
|---|---|---|
| CN | 2901771 | 5/2007 |
| CN | 200976685 | 11/2007 |
| CN | 102685942 | 9/2012 |
| CN | 106134285 | 11/2016 |
| DE | 19835378 | 2/2000 |
| EP | 0228808 | 7/1987 |
| EP | 0286215 | 10/1988 |
| EP | 0319079 | 6/1989 |
| EP | 0980193 | 2/2000 |
| GB | 2230852 | 10/1990 |
| JP | H0386116 | 4/1991 |
| JP | 2014-053574 | 3/2014 |
| KR | 101762159 | 8/2017 |
| WO | WO2009014333 | 1/2009 |

OTHER PUBLICATIONS

CN Office Action in Chinese Appln. No. 201910768853.2, dated Jun. 3, 2021, 16 pages (with English translation).

* cited by examiner

ELECTRIC HEATER

CROSS-REFERENCE TO RELATED APPLICATIONS

The present application claims priority under 35 U.S.C. 119 and 35 U.S.C. 365 to Korean Patent Application No. 10-2018-0097709, filed on Aug. 21, 2018, which is hereby incorporated by reference in its entirety.

FIELD

The present disclosure relates to an electric heater applicable to a cooking appliance, and more particularly, to an electric heater having a plane heating element with an optimized shape of heating tracks to provide an insulation gap in a limited area.

BACKGROUND

A cooking appliance can heat and cook various food items using gas or electricity. For example, the cooking appliance may include a microwave oven using microwaves, an oven using a heater, a gas stove using gas, an electric stove using electricity, or a cooktop including a gas stove or an electric stove.

In some examples, the gas stove may directly generate flame using gas as a heating source, while the electric stove may heat a container and food placed on a top plate thereof using electricity.

In some cases of the gas stove, heat loss can be caused by flame that is larger than the container, and contaminants may be discharged due to incomplete combustion, which may result in pollution of air in the room.

The electric stoves may include an inductive electric stove which can heat a container by a magnetic field generated by a magnetic induction method, and a resistive electric stove which can heat a top surface of the stove using a hot wire. In some cases, the top surface may be made of ceramic.

In some examples, the inductive electric stove may have a short cooking time at a high temperature using a magnetic container. The resistive electric stove may use an existing container but may have a relatively long cooking time.

In some examples, the resistive electric stove may include a heating element made of a nichrome wire. In some examples, an electric heater may use a plane heating element to reduce a thickness of the heating element.

In some cases, in order to shorten the cooking time, a resistive electric stove using an electric heater may heat a limited area at a high temperature.

For example, an electric heater may include a plane heating element including a substrate including a surface made of an electrically insulating material, a heating element attached to the surface of the substrate and having a predetermined shape, and a power supply for supplying electricity to the heating element.

In the electric heater, the temperature distribution of an object to be heated may be changed according to the shape (for example, the pattern) of the plane heating element, and the plane heating element may have a shape to heat the object uniformly.

In some cases, the plane heating element of the electric heater may include a plurality of tracks having a straight-line shape or an arc shape, where adjacent tracks of the plurality of tracks may be connected through a bridge (or a track).

As another example of the heater, a temperature sensitive device may include a printed a heater track made of a conductive material and a plurality of electrodes on a ceramic coating layer. In this example, based on current supplied through the electrodes, radiant heat may be generated in the heater track.

In some cases, a plane heating element may include a heating portion including one hot wire having a pattern within a limited area. The heating portion may be designed to have high resistance to generate heat at a temperature higher than 500 degree C.

In some cases, a pattern portion using one hot wire may have a limitation in providing power for various cooking appliance having different sizes or in generating heat to a high temperature according to user's needs.

In some examples, a plane heating element may include a hot wire having a plurality of pattern portions arranged to connect a start point with an end point in a limited area.

In some cases, the pattern portion may include, in order to closely arrange the hot wire in the limited area, arc-shaped tracks arranged at a constant gap.

When current flows in the pattern portion, a voltage may decreased from the start point to the end point of the hot wire. Therefore, a gap between hot wires, that is, an insulation gap, may be secured in proportion to an electric potential difference.

SUMMARY

The present disclosure provides an electric heater including a plane heating element that includes an optimized shape of a track to secure an insulation gap in a limited area.

According to one aspect of the subject matter described in this application, an electric heater includes: a substrate; and a plane heating element that is located at a surface of the substrate and that includes a pattern portion having a start point and an end point that are connected to each other. The pattern portion includes a plurality of tracks that are spaced apart from one another, that have an arc shape, and that are arranged at positions from an inner side of the pattern portion to an outer side of the pattern portion, where lengths of the plurality of tracks increase from the inner side to the outer side. The plurality of tracks include at least two tracks that are arranged respectively about a first center of curvature and a second center of curvature that is different from the first center of curvature.

Implementations according to this aspect may include one or more of the following features. For example, the at least two tracks among the plurality of tracks may be spaced apart from each other and face each other. In some examples, the first center of curvature may be located at a center of the pattern portion. In some examples, the plane heating element further includes an electrode portion connected to the start point and the end point of the pattern portion, where the second center of curvature is located farther from the electrode portion than the first center of curvature.

In some implementations, the pattern portion includes: a first track arranged about the first center of curvature; a second track located outside the first track and spaced apart from the first track, the second track being arranged about the second center of curvature; and a third track located outside the second track and spaced apart from the second track, the third track being arranged about a third center of curvature that is located at the first center of curvature.

In some examples, the plane heating element includes a first plane heating element, where the first plane heating element includes: a first pattern portion having a start point and an end point that are connected to each other through the first, second, and third tracks, the start point and the end point of the first pattern portion being located at an outermost side of the first pattern portion; and a first electrode portion connected to the start point and the end point of the first pattern portion. The first center of curvature and the third center of curvature may be located at a center of the first pattern portion.

In some implementations, the second center of curvature is located farther from the first electrode portion than the first center of curvature and the third center of curvature. In some examples, the first pattern portion defines a first gap and a second gap between the first track and the second track, the second gap being greater than the first gap, where the second gap is defined at a position of the first pattern portion farther from the first electrode portion than the first gap. In some examples, the first pattern portion defines a third gap and a fourth gap between the second track and the third track, the fourth gap being greater than the third gap, where the fourth gap is defined at a position of the first pattern portion closer to the first electrode portion than the third gap.

In some implementations, the plane heating element further includes a second plane heating element located outward of the first plane heating element, where the second plan heating element includes: a second pattern portion having a start point and an end point that are connected to each other through the first, second, and third tracks, the start point and the end point of the second pattern portion being located at an innermost side of the second pattern portion; and a second electrode portion connected to the start point and the end point of the second pattern portion. The first center of curvature and the third center of curvature may be located at a center of the second pattern portion.

In some examples, the second center of curvature is located closer to the second electrode portion than the first center of curvature and the third center of curvature. In some examples, the second pattern portion defines a first gap and a second gap between the first track and the second track, where the second gap of the second pattern portion is greater than the first gap of the second pattern portion. The second gap of the second pattern portion may be defined at a position of the second pattern portion closer to the second electrode portion than the first gap of the second pattern portion.

In some examples, the second pattern portion defines a third gap and a fourth gap between the second track and the third track, the fourth gap of the second pattern portion being greater than the third gap of the second pattern portion, where the fourth gap of the second pattern portion is defined at a position of the second pattern portion farther from the second electrode portion than the third gap of the second pattern portion.

In some implementations, the plurality of tracks include: a first section having a first radius of curvature; and a second section that extends from the first section and that has a second radius of curvature different from the first radius of curvature.

According to another aspect, an electric heater includes: a substrate; and a plane heating element located at a surface of the substrate, the plane heating element comprising a first plane heating element. The first plane heating element includes: a first pattern portion having a start point and an end point that are connected to each other and that are located at an outermost side of the first pattern portion, and a first electrode portion connected to the start point and the end point of the first pattern portion. The first pattern portion includes: a first track having an arc shape arranged about a first center of curvature; a second track located outside the first track and spaced apart from the first track, the second track having an arc shape arranged about a second center of curvature; and a third track located outside the second track and spaced apart from the second track, the third track having an arc shape arranged about a third center of curvature. The second center of curvature is located farther from the first electrode portion than the first center of curvature and the third center of curvature.

Implementations according to this aspect may include one or more of the following features. For example, the first pattern portion may define a first gap and a second gap between the first track and the second track, where the second gap is greater than the first gap, and the second gap is defined at a position of the first pattern portion farther from the first electrode portion than the first gap.

In some implementations, the first pattern portion defines a third gap and a fourth gap between the second track and the third track, where the fourth gap is greater than the third gap, and the fourth gap is defined at a position of the first pattern portion closer to the first electrode portion than the third gap.

In some implementations, the plane heating element further includes a second plane heating element. The second plane heating element may include: a second pattern portion that surrounds the first pattern portion and that has a start point and an end point that are connected each other, where the start point and the end point of the second pattern portion are located at an innermost side of the second pattern portion; and a second electrode portion connected to the start point and the end point of the second pattern portion. The second pattern portion may include: a fourth track having an arc shape arranged about a fourth center of curvature; a fifth track located outside the fourth track and spaced apart from the fourth track, where the fifth track has an arc shape arranged about a fifth center of curvature; and a sixth track located outside the fifth track and spaced apart from the fifth track, where the sixth track has an arc shape arranged about a sixth center of curvature. The fifth center of curvature may be located closer to the second electrode portion than the fourth center of curvature and the sixth center of curvature.

In some examples, the second pattern portion defines a first gap and a second gap between the fourth track and the fifth track, where the second gap of the second pattern portion is greater than the first gap of the second pattern portion, and the second gap of the second pattern portion is defined at a position of the second pattern portion closer to the second electrode portion than the first gap of the second pattern portion.

In some examples, the second pattern portion defines a third gap and a fourth gap between the fifth track and the sixth track, where the fourth gap of the second pattern portion is greater than the third gap of the second pattern portion, and the fourth gap of the second pattern portion is defined at a position of the second pattern portion farther from the second electrode portion than the third gap of the second pattern portion.

DETAILED DESCRIPTION

Hereinafter, the present implementation will be described in detail with reference to the accompanying drawings. It should be understood, however, that the scope of the inventive concept of the present implementation may be determined from the matters disclosed in the present implementation, and the spirit of the present disclosure possessed by the present implementation includes implementations such as addition, deletion, modification, and the like of components to the proposed implementation.

Figure 1:
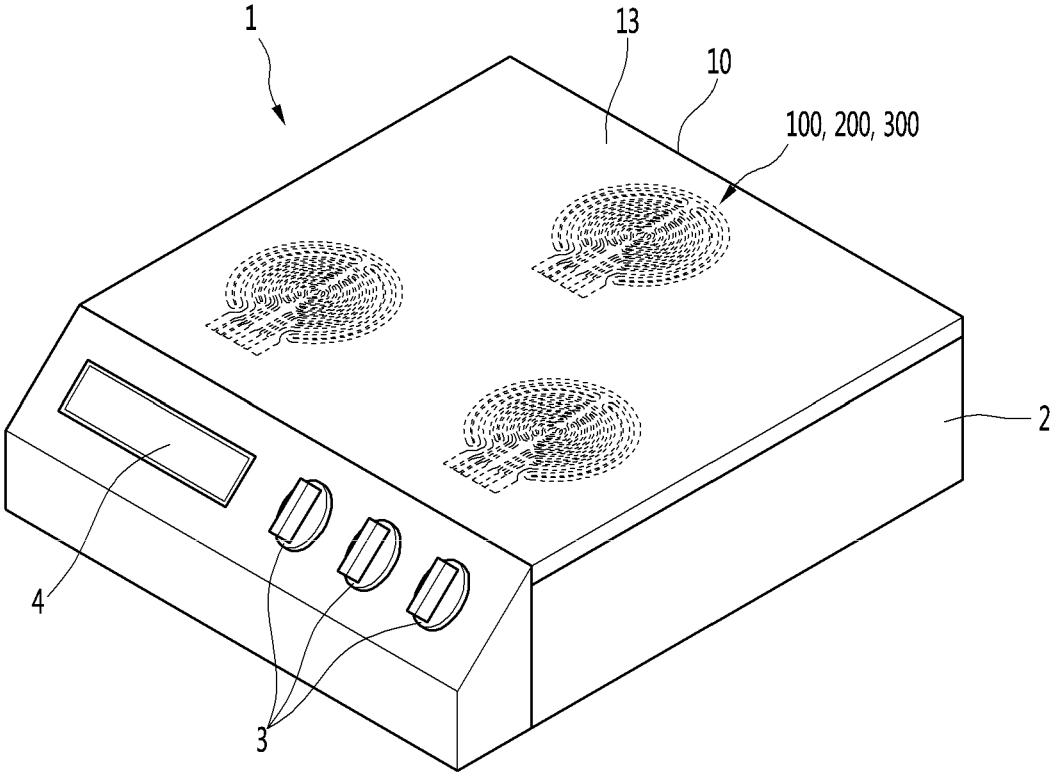
FIG. 1 is a perspective view showing an example electric stove including an example electric heater.
Figure 2:
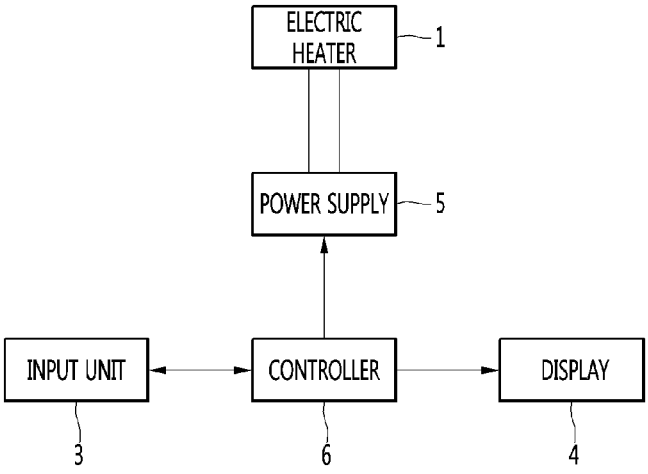
FIG. 2 is a control block diagram of an example electric stove including an example electric heater.

FIG. 1 is a perspective view showing an example electric stove including an electric heater, and FIG. 2 is a control block diagram of an example electric stove including an electric heater.

The electric heater 1 may configure a portion of an electric stove such as a cooktop.

The electric stove may include a cabinet 2 that defines an appearance of the electric stove. The electric heater 1 may be provided on the cabinet 2. The upper surface of the cabinet 2 may be opened and the electric heater 1 may be provided on the upper surface of the cabinet 2.

The electric stove may include an input unit 3 for manipulating the electric stove and a display 4 for displaying a variety of information such as information on the electric stove. In addition, the electric stove may further include a power supply 5 connected to the electric heater 1 to apply current to the electric heater 1. The electric stove may further include a controller 6 for controlling the power supply 5 and the display 4 according to input of the input unit 3.

The electric heater 1 may be provided on the cabinet 2 such that the upper surface thereof is exposed to the outside. An object to be heated by the electric stove may be placed on the upper surface of the electric heater 1, and the upper surface of the electric heater 1 may be a surface in which the object to be heated is seated.

Figure 3:
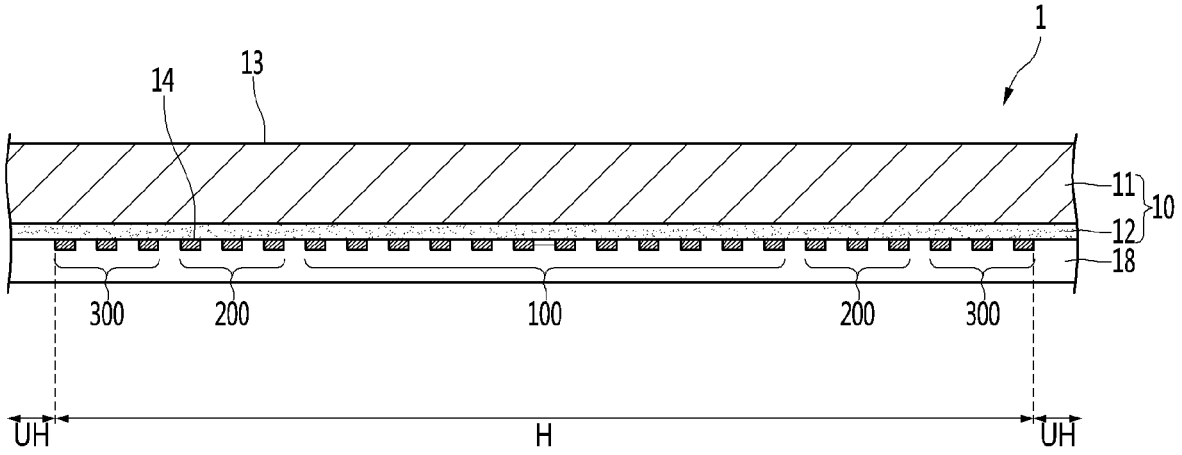
FIG. 3 is a cross-sectional view showing an example electric heater.

FIG. 3 is a cross-sectional view showing an example electric heater.

The electric heater 1 may include a substrate 10 and a plurality of plane heating elements 100, 200, and 300 located on one surface of the substrate 10.

The substrate 10 may be an insulating substrate having a conductor pattern defined on a surface thereof. The upper surface of the substrate 10 may be a surface 13 in which the object to be heated is seated. The lower surface of the substrate 10 may be a surface 14 in which the plane heating elements 100, 200, and 300 are defined.

The substrate 10 may include a base 11 made of an insulating material, or may include a base 11 made of an insulating material or a non-insulating material and an insulating layer 12 defined on one surface of the base 11.

In some implementations, the base 11 may be made of glass, and the insulating layer 12 may be provided on the lower surface of the glass using a coating or a printing method.

The plane heating elements 100, 200, and 300 may be directly defined on one surface of the base 11 made of an insulating material, or may be defined on the insulating layer 12.

The base 11 may have a shape of a plate on which the object to be heated is placed or in a shape of a container in which the object to be heated is received.

In some examples, the insulating layer 12 may be defined on the lower surface of the base 11. The insulating layer 12 may be located on the entire lower surface of the base 11 or may be located on a portion of the lower surface of the base 11. The insulating layer 12 may be located only in a zone in which the plane heating elements 100, 200, and 300 will be provided. The insulating layer 12 may configure the entire lower surface of the substrate 10 or a portion of the lower surface of the substrate 10.

The plane heating elements 100, 200, and 300 may be located on the lower surface 14 of the insulating layer 12. The plane heating elements 100, 200, and 300 may have a size smaller than the substrate 10 and the lower surface of the substrate 10 may have a heated zone H, in which the plane heating elements 100, 200, and 300 is provided, and an unheated zone UH located around the heated zone H.

The electric heater 1 may further include a coating layer 18 surrounding the plane heating elements 100, 200, and 300. The coating layer 18 may be made of an electrically insulating material to protect the plane heating element 100.

The substrate 10 of the present implementation may be made of a flexible material, such as a flexible insulating film. In this case, the electric heater 1 may be a flexible planar heater. Such a flexible planar heater may be attached to a member, on which the object to be heated is placed, to heat the object to be heated, like the upper plate of the electric stove.

Figure 4:
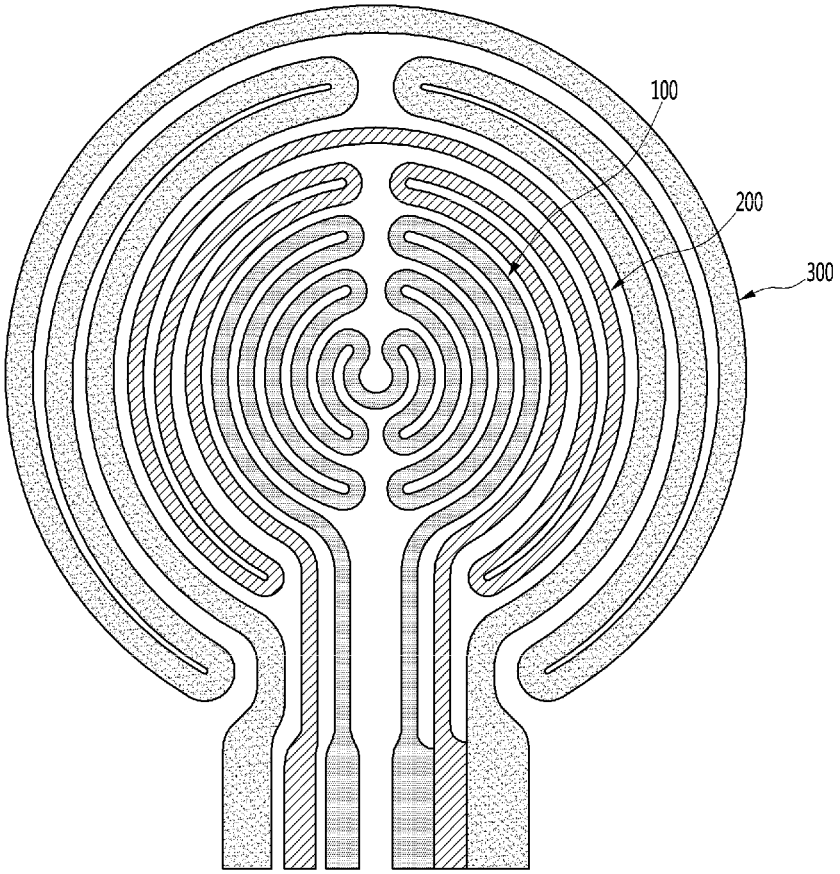
FIG. 4 is a plan view showing an example triple pattern type plane heating element.

FIG. 4 is a plan view showing an example triple pattern type plane heating element.

The triple pattern type plane heating element according to the implementation of the present disclosure includes a first plane heating element 100, a second plane heating element 200 and a third plane heating element 300 on the same plane as shown in FIG. 4. The first plane heating element 100 is located at the center, the second plane heating element 200 is located to surround the first plane heating element 100, and the third plane heating element 300 is located to surround the second plane heating element 200.

Current may be applied to the first, second, and third plane heating elements 100, 200, and 300 by one power supply. In some examples, the electrode portions of the first, second, and third plane heating elements 100, 200, and 300 may be located in the same direction.

Figure 5:
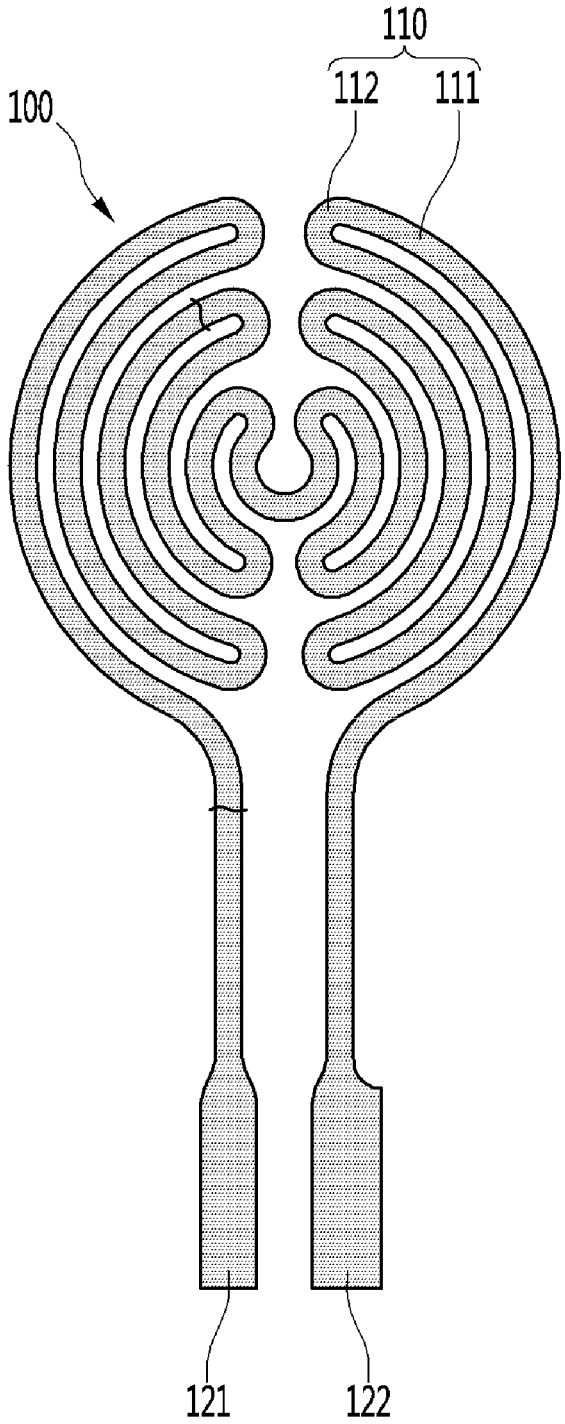
FIGS. 5 to 7 are views showing an example first plane heating element applied to FIG. 4 and example portions of the first plane heating element.
Figure 6:
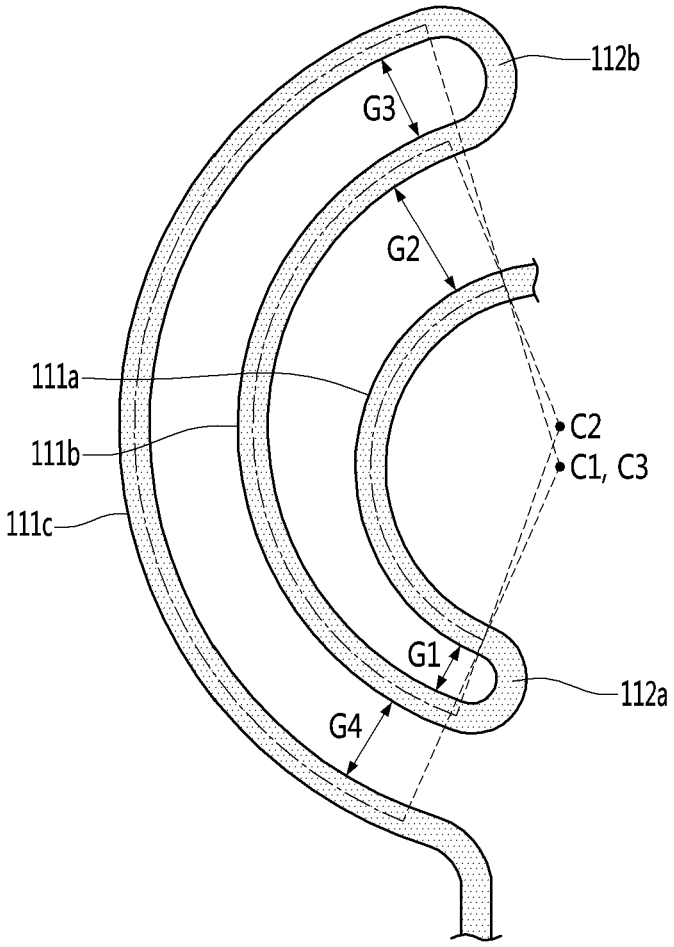
Figure 7:
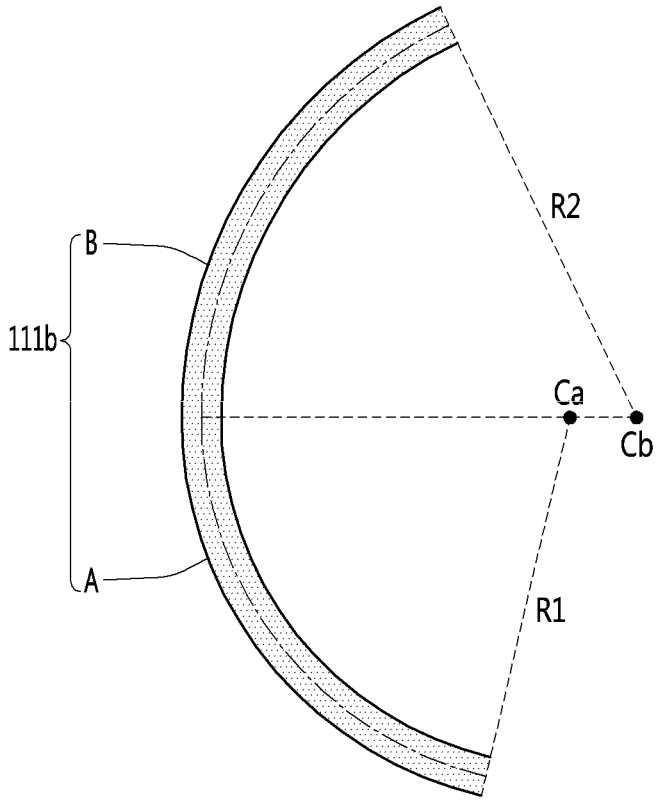

FIGS. 5 to 7 are views showing an example first plane heating element applied to FIG. 4 and examples portions of the first plane heating element.

The first plane heating element 100 includes a first pattern portion 110, in which a hot wire is arranged in a first zone in a predetermined shape, and a pair of first electrodes 121 and 122 connected to the first pattern portion 110, as shown in FIG. 5.

The first pattern portion 110 is a heating portion for generating heat at 500° C. or more, is configured by connecting the hot wire configuring the first pattern portion 110 between a start point and an end point located at the outermost side of a first zone along various paths, and is disposed on the left and right sides of a reference line passing through the center of the first pattern portion 110.

In some implementations, the first pattern portion 110 may be configured such that both sides thereof are opposed or are symmetrical with respect to the reference line.

In some implementations, the first pattern portion 110 may include a plurality of arc-shaped inner tracks 111 each having a length increasing the center to the outer side and an inner bridge 112 connecting the inner tracks 111 in series.

In order to secure an insulation gap according to a potential difference, a gap between the inner tracks 111 may be different for each position. This will be described in detail below.

The area of the first pattern portion 110 and the length of the hot wire configuring the first pattern portion 110 may be set to be proportional to required power.

The first electrodes 121 and 122 may be a non-heating portion which hardly generates heat or generates heat at 200° C. or less, and may include a first positive electrode 121 for receiving current and a first negative electrode 122 for outputting current.

The first positive electrode 121 and the first negative electrode 122 are non-heating portions and may be horizontally located outside second and third pattern portions 210 and 310, which are the below-described heating portions, at a predetermined gap.

The first positive electrode 121 extends from the start point of the first pattern portion 110, and the first negative electrode 122 extends from the end point of the first pattern portion 110.

However, the first electrodes 121 and 122 may have smaller resistance than the first pattern portion 110 to significantly reduce the heating temperature, and may have a larger thickness than the first pattern portion 110.

When current is supplied to the first plane heating element, current sequentially flows along the first positive electrode 121, the first pattern portion 110 and the first negative electrode 122.

Accordingly, the voltage is gradually decreased from the start point to the end point of the first pattern portion 110, a potential difference between adjacent inner tracks 111 is different for each position, and the insulation gap between adjacent inner tracks 111 may be set differently for each position.

As shown in FIG. 6, the first pattern portion 110 includes a first track 111*a* located on an inner side, a second track 111*b* located outside the first track 111*a*, a third track 111*c* located outside the second track 111*b*, a first bridge 112*a* connecting the first and second tracks 111*a* and 111*b* in series and a second bridge 112*b* connecting the second and third tracks 111*b* and 111*c* in series, and each of the first, second and third tracks 111*a*, 111*b* and 111*c* has an arc shape and has a constant width.

The centers of curvature $C_1$ and $C_3$ of the first and third tracks 111*a* and 111*c* coincide with the center of the first pattern portion 110 (shown in FIG. 5), but the center of curvature $C_2$ of the second track 111*b* is different from the centers of curvature $C_1$ and $C_3$ of the first and third tracks 111*a* and 111*c*. The second track 111*b* may be rotated by a predetermined angle from the center of the length of the arc forming the second track 111*b*.

In some implementations, the center of curvature $C_2$ of the second track 111*b* may be farther from the first electrodes 121 and 122 (shown in FIG. 5) than the centers of curvature $C_1$ and $C_3$ of the first and third tracks 111*a* and 111*c*.

Even if the centers of curvature $C_1$ and $C_3$ of the first and third tracks 111*a* and 111*c* are not changed but only the center of curvature $C_2$ of the second track 111*b* is changed, the gaps G1 and G2 between the first and second tracks 111*a* and 111*b* decrease as distances from the first electrode portions 121 and 122 (shown in FIG. 5) decrease, and the gaps G3 and G4 between the second and third tracks 111*b* and 111*c* increase as distances from the first electrodes 121 and 122 (shown in FIG. 5) decrease.

In some implementations, the first gap G1 between one ends of the first and second tracks 111*a* and 111*b* at a position close to the first bridge 112*a* is relatively short, but the second gap G2 between the other ends of the first and second tracks 111*a* and 111*b* at a position far from the first bridge 112*a* is relatively long.

In addition, the third gap G3 between the other ends of the second and third tracks 111*b* and 111*c* at a position close to the second bridge 112*b* is relatively short, but the gap G4 between one ends of the second and third tracks 111*b* and 111*c* at a position far from the second bridge 112*b* is relatively long.

In some implementations, when current flows from the start point to the end point of the first pattern portion 110 (shown in FIG. 5), current sequentially flows along the third track 111*c*, the second bridge 112*b*, the second track 111*b*, the first bridge 112*a* and the first track 111*a*.

However, as a potential difference between one ends of the second and third tracks 111*b* and 111*c* is relatively large, the fourth gap G4 is relatively long and, as the potential difference between the other ends of the second and third tracks 111*b* and 111*c* is relatively small, the third gap G3 is relatively short.

In addition, as the potential difference between the other ends of the first and second tracks 111*a* and 111*b* is relatively large, the second gap G2 is relatively long and, as the potential difference between one ends of the first and second tracks 111*a* and 111*b* is relatively small, the first gap G1 is relatively short.

Accordingly, if the centers of curvature $C_1$ and $C_3$ of the first and third tracks 111*a* and 111*c* are not changed and only the center of curvature $C_2$ of the second track 111*b* is changed to become far away from the first electrodes 121 and 122 (shown in FIG. 5) by changing only the shape of the second track 111*b*, it is possible to easily and simply secure the insulation gap which is different for each of the positions of the first, second and third tracks 111*a*, 111*b* and 111*c*.

As described above, in order to secure the insulation gap which is different for each positions of the first, second and third tracks 111*a*, 111*b* and 111*c*, although the center of curvature $C_2$ of the second track 111*b* may be different from the centers of curvature $C_1$ and $C_3$ of the first and third tracks 111*a* and 111*c*, as show in FIG. 7, the second track 111*b* may include first and second sections A and B having different radii of curvature R1 and R2.

In general, the second track 111*b* is designed in an arc shape to have a reference radius of curvature R such that a predetermined gap between adjacent tracks is maintained.

However, the second track 111*b* of the present disclosure includes a first section A having a first radius of curvature R1 less than the reference radius of curvature R and a second section B having a second radius of curvature R2 greater than the reference radius of curvature R.

That is, the first section A has a relatively small arc shape and the first radius of curvature R1 is less than the reference radius of curvature R. The second section B has a relatively large arc shape and the second radius of curvature R2 is greater than the reference radius of curvature R.

In some implementations, the first and second sections A and B configuring the second track 111*b* are continuous but have arc shapes having different radii of curvature.

Even if the second track 111*b* having the first and second sections A and B are located between the first and third tracks 111*a* and 111*c* as shown in FIG. 6, it is possible to secure the insulation gap which is different for each of the positions of the first, second and third tracks 111*a*, 111*b* and 111*c*.

Figure 8:
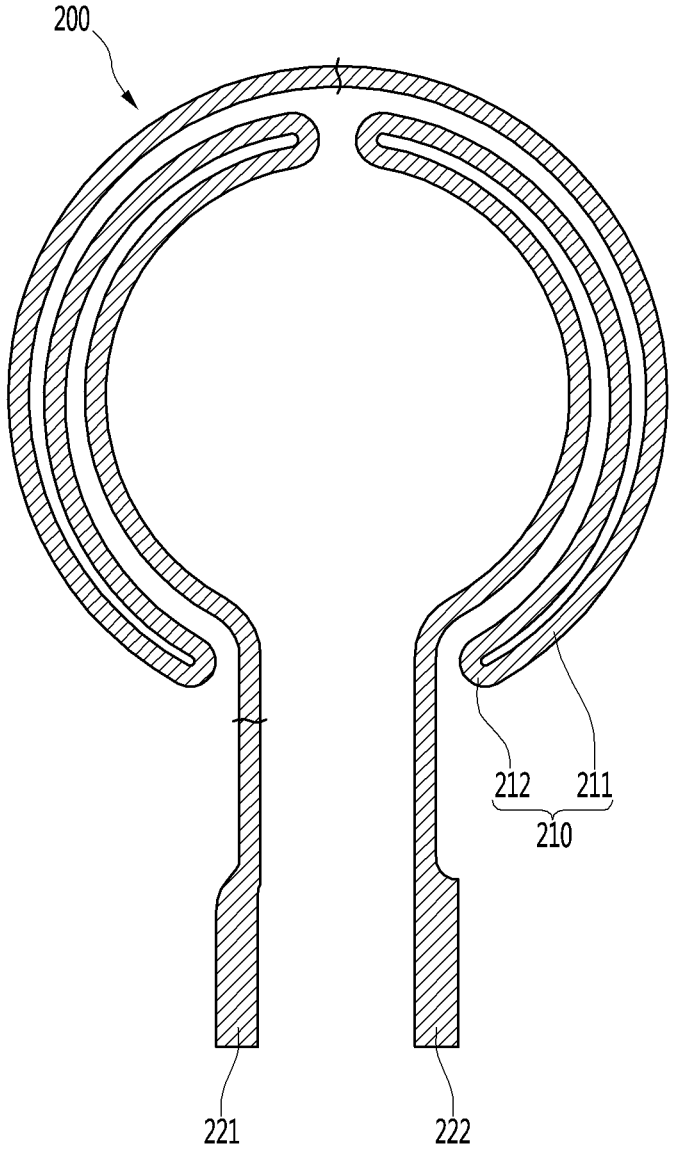
FIGS. 8 to 9 are views showing an example second plane heating element applied to FIG. 4 and example portions of the second heating element.
Figure 9:
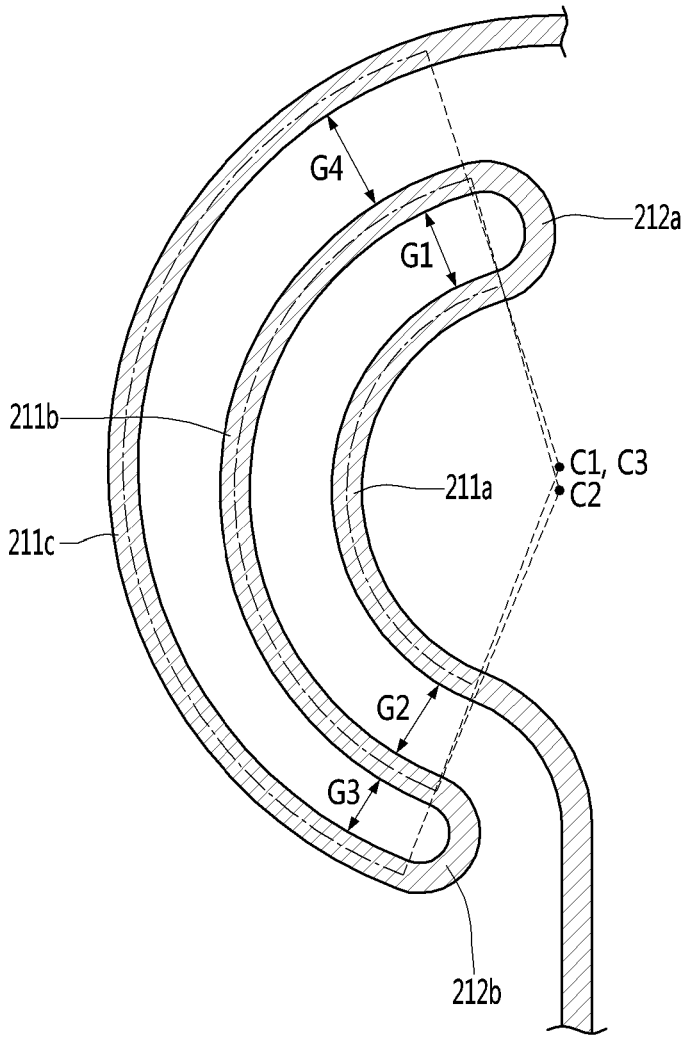

FIGS. 8 to 9 are views showing an example second plane heating element applied to FIG. 4 and example portions of the second heating element.

The second plane heating element 200 includes a second pattern portion 210, in which a hot wire is arranged in a predetermined shape in a ring-shaped second zone surrounding the first pattern portion 110, and a pair of second electrodes 221 and 222 connected to the second pattern portion 210, as shown in FIG. 8.

The second pattern portion 210 is also a heating portion for generating heat at 500° C. or more like the first pattern portion 110, is configured by connecting the hot wire configuring the second pattern portion 210 between a start point and an end point located in a second zone along various paths, and is disposed on the left and right sides of a reference line passing through the center of the second pattern portion 210.

In some implementations, the second pattern portion may be configured such that both sides thereof are opposed or are symmetrical with respect to the reference line.

According to the implementation, the second pattern portion 210 may also include a plurality of center tracks 211, which is bilaterally symmetrical, and a plurality of center bridges 212, similarly to the first pattern portion 110.

In order to secure an insulation gap according to a potential difference, a gap between the center tracks 211 may be different for each position. This will be described in detail below.

In order to keep the potential difference between the first and second pattern portions 110 and 210 (shown in FIG. 5) low, the start point and the end point of the second pattern portion 210 may be located at the innermost side of the second zone to be close to the start point and the end point of the first pattern portion 110.

The area of the second pattern portion 210 and the length of the hot wire configuring the second pattern portion 210 may be set to be proportional to required power.

The second electrodes 221 and 222 may be a non-heating portion which hardly generates heat or generates heat at 200° C. or less, and may include a second positive electrode 221 and a second negative electrode 222.

The second positive electrode 221 and the second negative electrode 222 are non-heating portions and may be horizontally located outside the second pattern portion 210 at a predetermined gap.

The second positive electrode 221 extends from the start point of the second pattern portion 210, and the second negative electrode 222 extends from the end point of the second pattern portion 210.

However, the second electrodes 221 and 222 may have smaller resistance than the second pattern portion 210 to significantly reduce the heating temperature, and may have a larger thickness than the second pattern portion 210.

Since the start points and the end points of the first and second pattern portions 110 and 210 (shown in FIG. 5) are adjacent, the first and second electrodes 121, 122, 211 and 222 (shown in FIG. 5) are located in the same direction, and one power supply may supply current to the first positive electrode 121 (shown in FIG. 5) and the second positive electrode 221.

In order to keep the potential difference between the first and second electrodes 121, 122, 221 and 222 (shown in FIGS. 5 and 8) low, the first and second positive electrodes 121 and 221 (shown in FIGS. 5 and 8) may be located adjacent to each other, and the first and second negative electrodes 122 and 222 (shown in FIGS. 5 and 8) may be located adjacent to each other.

When current is supplied to the second plane heating element 200, current sequentially flows along the second positive electrode 221, the second pattern portion 210 and the second negative electrode 222.

Accordingly, the voltage is gradually decreased from the start point to the end point of the second pattern portion 210, a potential difference between adjacent center tracks 211 is different for each position, and the insulation gap between adjacent center tracks 211 may be set differently for each position.

As shown in FIG. 9, the second pattern portion 210 includes a fourth track 211*a* located at an inner side, a fifth track 211*b* located outside the fourth track 211*a*, a sixth track 211*c* located outside the fifth track 211*b*, a third bridge 212*a* connecting the fourth and fifth tracks 211*a* and 211*b* in series and a fourth bridge 212*b* connecting the fifth and sixth tracks 211*b* and 211*c* in series, and each of the fourth, fifth, and sixth tracks 211*a*, 211*b*, and 211*c* has an arc shape and has a constant width.

The centers of curvature $C_1$ and $C_3$ of the fourth and sixth tracks 211*a* and 211*c* coincide with the center of the second pattern portion 210 (shown in FIG. 8), but the center of curvature $C_2$ of the fifth track 211*b* is different from the centers of curvature $C_1$ and $C_3$ of the fourth and sixth tracks 211*a* and 211*c*. The fifth track 211*b* may be rotated by a predetermined angle from the center of the length of the arc forming the fifth track 211*b*.

In some implementations, the center of curvature $C_2$ of the fifth track 211*b* may be closer to the second electrodes 221 and 222 (shown in FIG. 8) than the centers of curvature $C_1$ and $C_3$ of the fourth and sixth tracks 211*a* and 211*c*.

Even if the centers of curvature $C_1$ and $C_3$ of the fourth and sixth tracks 211*a* and 211*c* are not changed but only the center of curvature $C_2$ of the fifth track 211*b* is changed, the gaps G1 and G2 between the fourth and fifth tracks 211*a* and 211*b* increase as distances from the second electrode portions 221 and 222 (shown in FIG. 8) decrease, and the gaps G3 and G4 between the fifth and sixth tracks 211*b* and 211*c* decrease as distances from the second electrodes 221 and 222 (shown in FIG. 8) decrease.

In some implementations, the first gap G1 between one ends of the fourth and fifth tracks 211*a* and 211*b* at a position close to the third bridge 212*a* is relatively short, but the second gap G2 between the other ends of the fourth and fifth tracks 211*a* and 211*b* at a position far from the third bridge 212*a* is relatively long.

In addition, the third gap G3 between the other ends of the fifth and sixth tracks 211*b* and 211*c* at a position close to the fourth bridge 212*b* is relatively short, but the gap G4 between one ends of the fifth and sixth tracks 211*b* and 211*c* at a position far from the fourth bridge 212*b* is relatively long.

In some implementations, when current flows from the start point to the end point of the second pattern portion 210 (shown in FIG. 8), current sequentially flows along the fourth track 211*a*, the third bridge 212*a*, the fifth track 211*b*, the fourth bridge 212*b* and the sixth track 211*c*.

However, as an electric potential difference between one ends of the fourth and fifth tracks 211*a* and 211*b* is relatively small, the first gap G1 is relatively short and, as the potential difference between the other ends of the fourth and fifth tracks 211*a* and 211*b* is relatively large, the second gap G2 is relatively long.

In addition, as the potential difference between the other ends of the fifth and sixth tracks 211*b* and 211*c* is relatively small, the third gap G3 is relatively short and, as the potential difference between one ends of the fifth and sixth tracks 211*b* and 211*c* is relatively large, the fourth gap G4 is relatively long.

Accordingly, if the centers of curvature $C_1$ and $C_3$ of the fourth and sixth tracks 211*a* and 211*c* are not changed and only the center of curvature $C_2$ of the fifth track 211*b* is changed to become closer to the second electrodes 221 and 222 (shown in FIG. 8) by changing only the shape of the fifth track 211*b*, it is possible to easily and simply secure the insulation gap which is different for each of the positions of the fourth, fifth, and sixth tracks 211*a*, 211*b*, and 211*c*.

Figure 10:
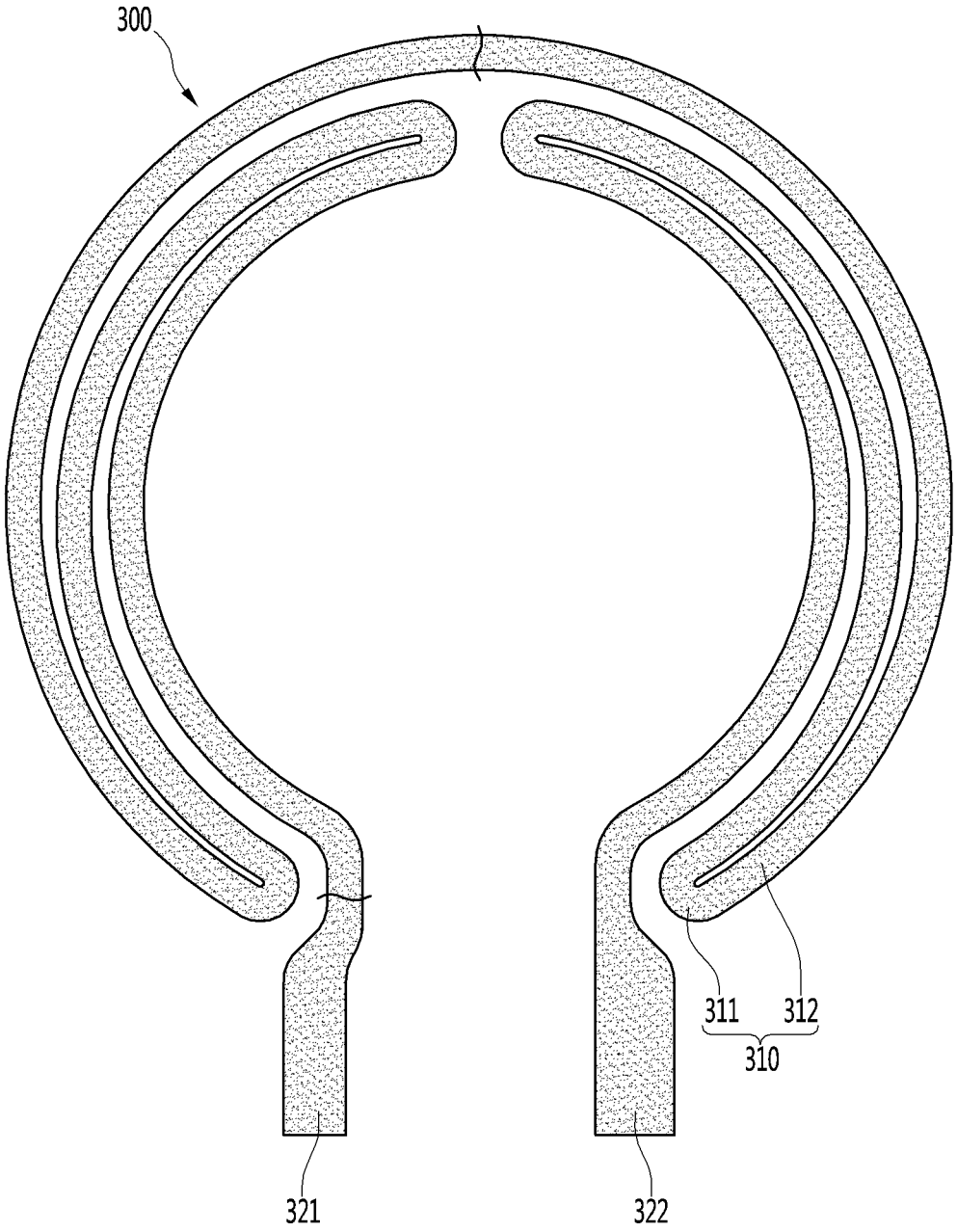
FIGS. 10 to 11 are views showing an example third plane heating element applied to FIG. 4 and example portions of the third heating element.
Figure 11:
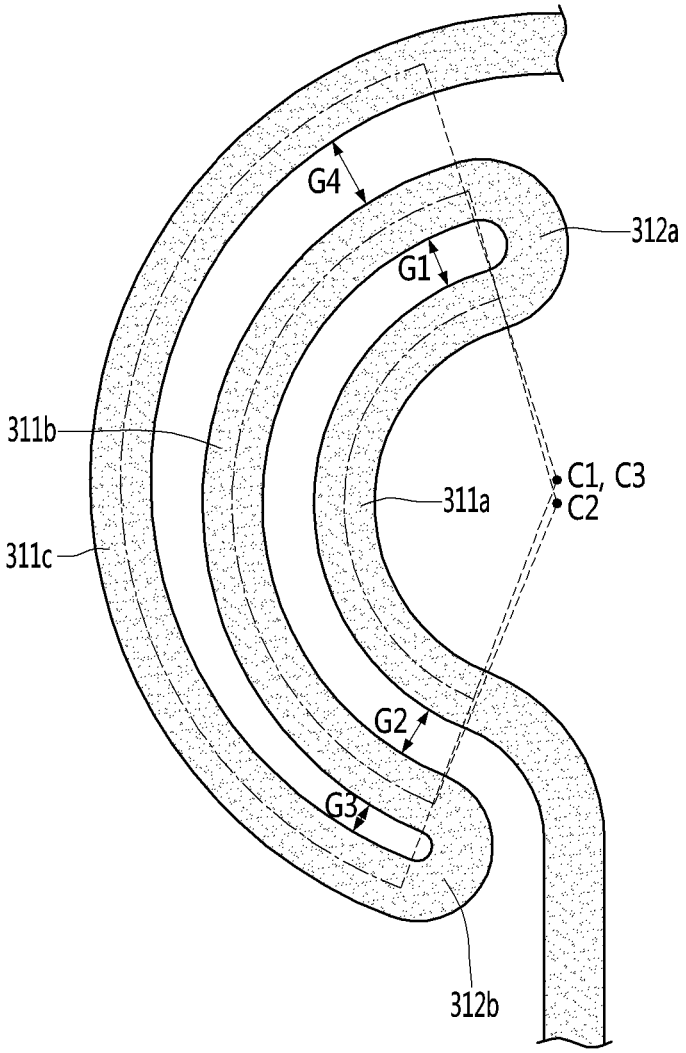

FIGS. 10 and 11 are views showing a third plane heating element applied to FIG. 4 and a portion thereof.

The third plane heating element 300 includes a third pattern portion 310, in which a hot wire is arranged in a predetermined shape in a ring-shaped third zone surrounding the second pattern portion 210, and a pair of third electrodes 321 and 322 connected to the third pattern portion 310, as shown in FIG. 10.

The third pattern portion 310 is also a heating portion for generating heat at 500° C. or more like the first pattern portion 110, is configured by connecting the hot wire configuring the third pattern portion 310 between a start point and an end point located in a third zone along various paths, and is disposed on the left and right sides of a reference line passing through the center of the third pattern portion 310.

In some implementations, the third pattern portion may be configured such that both sides thereof are opposed or are symmetrical with respect to the reference line.

According to the implementation, the third pattern portion 310 may also include a plurality of outer tracks 311, which is bilaterally symmetrical, and a plurality of outer bridges 312, similarly to the first pattern portion 110.

In order to secure an insulation gap according to a potential difference, a gap between the outer tracks 311 may be different for each position. This will be described in detail below.

In order to keep the potential difference between the second and third pattern portions 210 and 310 (shown in FIG. 8) low, the start point and the end point of the third pattern portion 310 may be located at the innermost side of the third zone to be close to the start point and the end point of the second pattern portion 210.

The area of the third pattern portion 310 and the length of the hot wire configuring the third pattern portion 310 may be set to be proportional to required power.

The third electrodes 321 and 322 may be a non-heating portion which hardly generates heat or generates heat at 200° C. or less, may include a third positive electrode 321 and a third negative electrode 322, and may be horizontally located outside the third pattern portion 310 at a predetermined gap.

The third positive electrode 321 extends from the start point of the third pattern portion 310, and the third negative electrode 322 extends from the end point of the third pattern portion 310. The third electrodes 321 and 322 may have smaller resistance than the third pattern portion 310 to significantly reduce the heating temperature, and may have a larger thickness than third pattern portion 310.

The third electrodes 321 and 322 are located in the same direction as the first and second electrodes 121, 122, 211 and 222 (shown in FIGS. 5 and 8), and one power supply may supply current to the first positive electrode 121 (shown in FIG. 5), the second positive electrode 221 (shown in FIG. 8) and the third positive electrode 321.

When current is supplied to the third plane heating element 300, current sequentially flows along the third positive electrode 321, the third pattern portion 310 and the third negative electrode 322.

Accordingly, the voltage is gradually decreased from the start point to the end point of the third pattern portion 310, a potential difference between adjacent outer tracks 311 is different for each position, and the insulation gap between adjacent outer tracks 311 may be set differently for each position.

As shown in FIG. 11, the third pattern portion 310 includes a seventh track 311*a* located at an inner side, an eighth track 311*b* located outside the seventh track 311*a*, a ninth track 311*c* located outside the eighth track 311*b*, a fifth bridge 312*a* connecting the seventh and eighth tracks 311*a* and 311*b* in series and a sixth bridge 312*b* connecting the eighth and ninth tracks 311*b* and 311*c*, and each of the seventh, eighth and ninth tracks 311*a*, 311*b* and 311*c* has an arc shape and has a constant width.

The centers of curvature $C_1$ and $C_3$ of the seventh and ninth tracks 311*a* and 311*c* coincide with the center of the third pattern portion 310 (shown in FIG. 10), but the center of curvature $C_2$ of the eighth track 311*b* is different from the centers of curvature $C_1$ and $C_3$ of the seventh and ninth tracks 311*a* and 311*c*. The eighth track 311*b* may be rotated by a predetermined angle from the center of the length of the arc forming the eighth track 311*b*.

In some implementations, the center of curvature $C_2$ of the eighth track 311*b* may be closer to the third electrodes 321 and 322 (shown in FIG. 10) than the centers of curvature $C_1$ and $C_3$ of the seventh and ninth tracks 311*a* and 311*c*.

Even if the centers of curvature $C_1$ and $C_3$ of the seventh and ninth tracks 311*a* and 311*c* are not changed but only the center of curvature $C_2$ of the eighth track 311*b* is changed, the gaps G1 and G2 between the seventh and eighth tracks 311*a* and 311*b* increase as distances from the third electrode portions 321 and 322 (shown in FIG. 10) decrease, and the gaps G3 and G4 between the eighth and ninth tracks 311*b* and 311*c* decrease as distances from the third electrodes 321 and 322 (shown in FIG. 10) decrease.

In some implementations, the first gap G1 between one ends of the seventh and eighth tracks 311*a* and 311*b* at a position close to the fifth bridge 312*a* is relatively short, but the second gap G2 between the other ends of the seventh and eighth tracks 311*a* and 311*b* at a position far from the fifth bridge 312*a* is relatively long.

In addition, the third gap G3 between the other ends of the eighth and ninth tracks 311*b* and 311*c* at a position close to the sixth bridge 312*b* is relatively short, but the gap G4 between one ends of the eighth and ninth tracks 311*b* and 311*c* at a position far from the sixth bridge 312*b* is relatively long.

In some implementations, when current flows from the start point to the end point of the third pattern portion 310 (shown in FIG. 10), current sequentially flows along the seventh track 311*a*, the fifth bridge 312*a*, the eighth track 311*b*, the sixth bridge 312*b* and the ninth track 311*c*.

However, as a potential difference between one ends of the seventh and eighth tracks 311*a* and 311*b* is relatively small, the first gap G1 is relatively short and, as the potential difference between the other ends of the seventh and eighth tracks 311*a* and 311*b* is relatively large, the second gap G2 is relatively long.

In addition, as the potential difference between the other ends of the eighth and ninth tracks 311*b* and 311*c* is relatively small, the third gap G3 is relatively short and, as the potential difference between one ends of the eighth and ninth tracks 311*b* and 311*c* is relatively large, the fourth gap G4 is relatively long.

Accordingly, if the centers of curvature $C_1$ and $C_3$ of the seventh and ninth tracks 311*a* and 311*c* are not changed and only the center of curvature $C_2$ of the eighth track 311*b* is changed to become closer to the third electrodes 321 and 322 (shown in FIG. 10) by changing only the shape of the eighth track 311*b*, it is possible to easily and simply secure the insulation gap which is different for each of the positions of the seventh, eighth and ninth tracks 311*a*, 311*b* and 311*c*.

Figure 12:
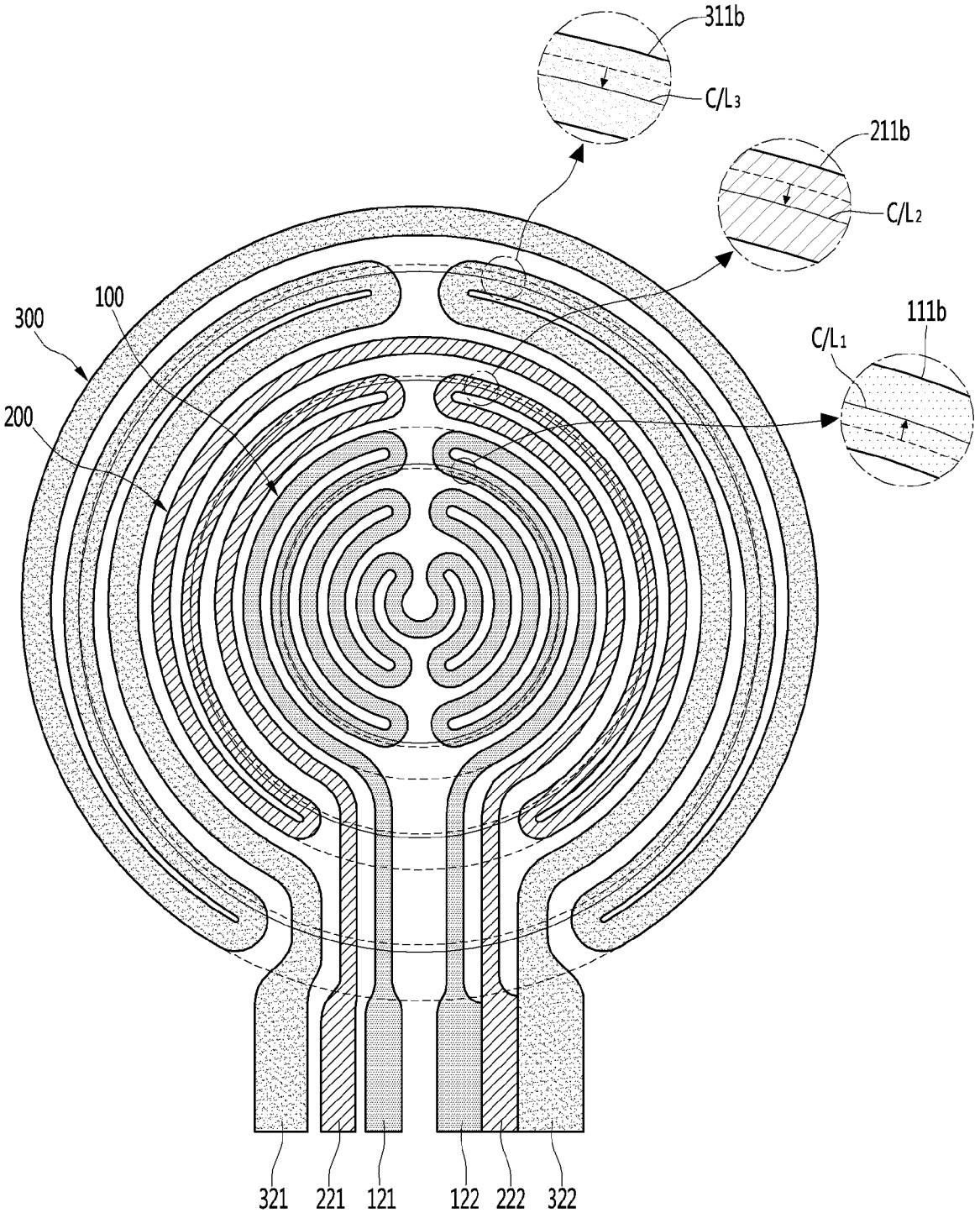
FIG. 12 is a view showing an example of degrees of curvature of tracks in an example triple pattern type plane heating element.

FIG. 12 is a view showing an example of a degree of twist of some of tracks of an example triple pattern type plane heating element.

The tracks included in the plane heating element are designed to have an arc shape, to be concentrically located and to have the same center of curvature.

In some cases, some tracks may be twisted between the other tracks, and centers of curvature of some tracks may be located at different positions from centers of the other tracks.

For example, the center of curvature of the first track 111*a* included in the first plane heating element 100 may be located farther from the first electrode portions 121 and 122 than that of the other first tracks.

In other words, a first center line $C/L_1$ passing through the center of the width of the first track 111*a* included in the first plane heating element 100 may be farther from the first electrode portions 121 and 122 than the center of the first plane heating element 100.

In some implementations, where the start point and the end point of the pattern portion including the first track 111*a* are located at the outermost side of the zone in which the pattern portion is provided, the center of curvature of the first track 111*a* may be farther than the first electrode portions 121 and 122.

In some examples, the center of curvature of the fifth track 211*b* included in the second plane heating element 200 may be located closer to the second electrode portions 221 and 222 than the other second tracks.

In other words, a second center line $C/L_2$ passing through the center of the width of the fifth track 211*b* included in the second plane heating element 200 may be closer to the second electrode portions 221 and 222 than the center of the first plane heating element 100.

In some implementations, where the start point and the end point of the pattern portion including the fifth track 211*b* are located at the innermost side of the zone in which the pattern portion is provided, the center of curvature of the fifth track 211*b* may be located closer to the second electrode portions 221 and 222.

In some cases, the center of curvature of the eighth track 311*b* included in the third plane heating element 300 may be located closer to the third electrode portions 321 and 322 than the other third tracks.

In other words, a third center line $C/L_3$ passing through the center of the width of the eighth track 311*b* included in the third plane heating element 300 may be closer to the third electrode portions 321 and 322 than the center of the first plane heating element 100.

Similarly, if the start point and the end point of the pattern portion including the eighth track 311*b* are located at the outermost side of the zone in which the pattern portion is provided, the center of curvature of the eighth track 311*b* may be closer to the third electrode portions 321 and 322.

As described above, if the start point and the end point are located at the outermost zone, in which the pattern portion is provided, and the pattern portion is configured to include the arc-shaped tracks each having a length increasing from the inner side to the outer side, it is possible to simply secure the insulation gap which is different for each position of the track, when the center of curvature of one track is farther from the electrode portion than the center of curvature of the other two tracks.

In contrast, if the start point and the end point are located in the innermost zone in which the pattern portion is provided, it is possible to simply secure the insulation gap which is different for each position of the track, when the center of curvature of one track is closer to the electrode portion than the center of curvature of the other two adjacent tracks.

The electric heater according to the present disclosure includes a plane heating element including arc-shaped first, second and third tracks each having a length increasing from an inner side to an outer side in a limited area. By making the centers of curvatures of adjacent tracks different or making the center of curvature of the second track different from the centers of curvature of the first and third tracks, it is possible to optimize the shape of the track such that the gap between the adjacent tracks is different for each position.

Accordingly, even if the shape of one of the plurality of tracks provided in the limited area is changed, it may be possible to secure the insulation gap in proportion to the potential difference and to prevent dielectric breakdown between the tracks.

What is claimed is:

1. An electric heater comprising:

a substrate; and a plane heating element located at a surface of the substrate, the plane heating element including a pattern portion having a start point and an end point that are connected to each other, wherein the pattern portion comprises a plurality of tracks that are spaced apart from one another, that have an arc shape, and that are arranged at positions from an inner side of the pattern portion to an outer side of the pattern portion, lengths of the plurality of tracks increasing from the inner side to the outer side, wherein the plurality of tracks comprise at least two tracks that are arranged respectively about a first center of curvature and a second center of curvature that is different from the first center of curvature, and wherein the pattern portion comprises:

a first track arranged about the first center of curvature, a second track located outside the first track and spaced apart from the first track, the second track being arranged about the second center of curvature, and a third track located outside the second track and spaced apart from the second track, the third track being arranged about a third center of curvature that is located at the first center of curvature.

2. The electric heater of claim 1, wherein the at least two tracks among the plurality of tracks are spaced apart from each other and face each other.

3. The electric heater of claim 2, wherein the first center of curvature is located at a center of the pattern portion.

4. The electric heater of claim 3, wherein the plane heating element further comprises an electrode portion connected to the start point and the end point of the pattern portion, and wherein the second center of curvature is located farther from the electrode portion than the first center of curvature.

5. The electric heater of claim 1, wherein the plane heating element comprises a first plane heating element, wherein the first plane heating element comprises:

a first pattern portion having a start point and an end point that are connected to each other through the first, second, and third tracks, the start point and the end point of the first pattern portion being located at an outermost side of the first pattern portion; and a first electrode portion connected to the start point and the end point of the first pattern portion, and wherein the first center of curvature and the third center of curvature are located at a center of the first pattern portion.

6. The electric heater of claim 5, wherein the second center of curvature is located farther from the first electrode portion than the first center of curvature and the third center of curvature.

7. The electric heater of claim 6, wherein the first pattern portion defines a first gap and a second gap between the first track and the second track, the second gap being greater than the first gap, and wherein the second gap is defined at a position of the first pattern portion farther from the first electrode portion than the first gap.

8. The electric heater of claim 6, wherein the first pattern portion defines a third gap and a fourth gap between the second track and the third track, the fourth gap being greater than the third gap, and wherein the fourth gap is defined at a position of the first pattern portion closer to the first electrode portion than the third gap.

9. The electric heater of claim 5, wherein the plane heating element further comprises a second plane heating element located outward of the first plane heating element, wherein the second plan heating element comprises:

a second pattern portion having a start point and an end point that are connected to each other through the first, second, and third tracks, the start point and the end point of the second pattern portion being located at an innermost side of the second pattern portion; and a second electrode portion connected to the start point and the end point of the second pattern portion, and wherein the first center of curvature and the third center of curvature are located at a center of the second pattern portion.

10. The electric heater of claim 9, wherein the second center of curvature is located closer to the second electrode portion than the first center of curvature and the third center of curvature.

11. The electric heater of claim 10, wherein the second pattern portion defines a first gap and a second gap between the first track and the second track, the second gap of the second pattern portion being greater than the first gap of the second pattern portion, and wherein the second gap of the second pattern portion is defined at a position of the second pattern portion closer to the second electrode portion than the first gap of the second pattern portion.

12. The electric heater of claim 10, wherein the second pattern portion defines a third gap and a fourth gap between the second track and the third track, the fourth gap of the second pattern portion being greater than the third gap of the second pattern portion, and wherein the fourth gap of the second pattern portion is defined at a position of the second pattern portion farther from the second electrode portion than the third gap of the second pattern portion.

13. The electric heater of claim 1, wherein the plurality of tracks comprise:

a first section having a first radius of curvature; and a second section that extends from the first section and that has a second radius of curvature different from the first radius of curvature.

14. An electric heater comprising:

a substrate; and a plane heating element located at a surface of the substrate, the plane heating element comprising a first plane heating element, wherein the first plane heating element comprises:

a first pattern portion having a start point and an end point that are connected to each other and that are located at an outermost side of the first pattern portion, and a first electrode portion connected to the start point and the end point of the first pattern portion, wherein the first pattern portion comprises:

a first track having an arc shape arranged about a first center of curvature, a second track located outside the first track and spaced apart from the first track, the second track having an arc shape arranged about a second center of curvature, and a third track located outside the second track and spaced apart from the second track, the third track having an arc shape arranged about a third center of curvature, and wherein the second center of curvature is located farther from the first electrode portion than the first center of curvature and the third center of curvature.

15. The electric heater of claim 14, wherein the first pattern portion defines a first gap and a second gap between the first track and the second track, the second gap being greater than the first gap, and wherein the second gap is defined at a position of the first pattern portion farther from the first electrode portion than the first gap.

16. The electric heater of claim 14, wherein the first pattern portion defines a third gap and a fourth gap between the second track and the third track, the fourth gap being greater than the third gap, and wherein the fourth gap is defined at a position of the first pattern portion closer to the first electrode portion than the third gap.

17. The electric heater of claim 14, wherein the plane heating element further comprises a second plane heating element, wherein the second plane heating element comprises:

a second pattern portion that surrounds the first pattern portion and that has a start point and an end point that are connected each other, the start point and the end point of the second pattern portion being located at an innermost side of the second pattern portion, and a second electrode portion connected to the start point and the end point of the second pattern portion, wherein the second pattern portion comprises:

a fourth track having an arc shape arranged about a fourth center of curvature, a fifth track located outside the fourth track and spaced apart from the fourth track, the fifth track having an arc shape arranged about a fifth center of curvature, and a sixth track located outside the fifth track and spaced apart from the fifth track, the sixth track having an arc shape arranged about a sixth center of curvature, and wherein the fifth center of curvature is located closer to the second electrode portion than the fourth center of curvature and the sixth center of curvature.

18. The electric heater of claim 17, wherein the second pattern portion defines a first gap and a second gap between the fourth track and the fifth track, the second gap of the second pattern portion being greater than the first gap of the second pattern portion, and wherein the second gap of the second pattern portion is defined at a position of the second pattern portion closer to the second electrode portion than the first gap of the second pattern portion.

19. The electric heater of claim 17, wherein the second pattern portion defines a third gap and a fourth gap between the fifth track and the sixth track, the fourth gap of the second pattern portion being greater than the third gap of the second pattern portion, and wherein the fourth gap of the second pattern portion is defined at a position of the second pattern portion farther from the second electrode portion than the third gap of the second pattern portion.

* * * * *